US007181932B2

(12) United States Patent
Kosui

(10) Patent No.: US 7,181,932 B2
(45) Date of Patent: Feb. 27, 2007

(54) KNITTING METHOD OF FORMING DRAPE AROUND COLLAR AND KNITWEAR HAVING DRAPE AROUND COLLAR

(75) Inventor: Tatsuya Kosui, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/569,939

(22) PCT Filed: Sep. 27, 2004

(86) PCT No.: PCT/JP2004/014082

§ 371 (c)(1),
(2), (4) Date: Feb. 28, 2006

(87) PCT Pub. No.: WO2005/031055

PCT Pub. Date: Apr. 7, 2005

(65) Prior Publication Data

US 2007/0017256 A1 Jan. 25, 2007

(30) Foreign Application Priority Data

Sep. 29, 2003 (JP) ..... 2003-337506

(51) Int. Cl.
*D04B 7/10* (2006.01)

(52) U.S. Cl. ..... 66/70; 66/176

(58) Field of Classification Search ..... 66/176, 66/64, 69, 70, 71, 171, 175
See application file for complete search history.

(56) References Cited

U.S. PATENT DOCUMENTS

| | | | | |
|---|---|---|---|---|
| 5,987,930 | A * | 11/1999 | Nakai | 66/69 |
| 6,564,588 | B1 * | 5/2003 | Nonnenmacher et al. | 66/69 |
| 6,672,113 | B2 * | 1/2004 | Okamoto | 66/76 |
| 6,889,530 | B2 * | 5/2005 | Urano et al. | 66/64 |

FOREIGN PATENT DOCUMENTS

| | | |
|---|---|---|
| JP | 54-87206 U | 6/1979 |
| JP | 4-214448 A | 8/1992 |
| WO | 01/94672 A1 | 12/2001 |

* cited by examiner

*Primary Examiner*—Danny Worrell
(74) *Attorney, Agent, or Firm*—Rothwell, Figg, Ernst & Manbeck, P.C.

(57) ABSTRACT

The invention aims to knit knitwear in a substantially seamless manner, with the number of courses around the neck increased, so that when the knitwear is worn, a drape can be formed around the neck.

In knitting zones extending from underarms to before shoulders, the front body and the back body split at both ends thereof are increased in knitting width so that a drape can be formed around the neck of the front body. The front body and the back body are knitted by a flechage knitting so that shoulder drops can be formed in their shoulder parts. Then, they are bound off at their front and back necklines and also joined together at their shoulder lines.

5 Claims, 3 Drawing Sheets

KNITTING METHOD OF FORMING DRAPE AROUND COLLAR AND KNITWEAR HAVING DRAPE AROUND COLLAR

CROSS REFERENCE TO RELATED APPLICATION

This application is a 35 USC § 371 National Phase Entry Application from PCT/JP2004/014082, filed Sep. 27, 2004, and designating the United States.

TECHNICAL FIELD

The present invention relates to a knitting method for forming drape around the neck of knitwear, such as, for example, a sweater, a one-piece suit, and a dress, knitted by using a flat knitting machine, and to knitwear knitted by the same knitting method.

BACKGROUND ART

The applicant has proposed various knitting methods of knitting knitwear in a seamless manner using a flat knitting machine to eliminate or simplify a later sewing process. Patent Document 1 describes a knitting method for providing a rib knitting in tubular form and providing an increased or decreased knitting width, using a two-bed flat knitting machine, which is characterized in knitting with knitting needles on front and back needle beds on a half gauge basis. Patent Documents 2 and 3 describe a knitting method for forming a sufficiently large front drop at, for example, a round neckline of a sweater knitted seamlessly. Patent Document 4 discloses a knitting method for forming a V neckline in a sweater knitted seamlessly, using a two-bed or four-bed flat knitting machine.

However, since the knitting methods of the Patent Documents cited above are intended for a common neckline, such as a round-neck and a V-neck, they cannot be used as-proposed to knit a sweater having a drape neckline, such as, an off turtleneck, formed around the neckline. Under the circumstances, a knitting method including a sewing process is used almost exclusively for producing knitwear having such a drape-neckline.

Patent Document 1: JP Patent Publication No. Hei 7-37698,

Patent Document 2: International Publication No. WO01/55491,

Patent Document 3: International Publication No. WO01/94672, and

Patent Document 4: JP Patent Laid-open (Unexamined) Publication No. Hei 4-153346.

DISCLOSURE OF THE INVENTION

Problem to be Solved by the Invention

The present invention aims to provide a knitting method for seamless knitwear with drape formed around the neck when worn by knitting substantially seamlessly with an increased number of courses around the neck, and provide such knitwear.

Means for Solving the Problem

The present invention provides a knitting method for knitting knitwear in tubular form whose front body part and back body part are joined together at both ends of knitting widths thereof, with the front body part and the back body part assigned to a first needle bed and a second needle bed, respectively, and which has a drape around a neck, by using a flat knitting machine having at least a pair of front and back needle beds extending in a transverse direction and disposed opposite to each other in a cross direction, at least either of which is capable of being racked in the transverse direction so that loops can be transferred between the front and back needle beds, the method comprising:

a) the step of knitting the front and back bodies in tubular form in knitting zones extending from hems to underarms, with front and back bodies joined at both ends thereof (Knitting zone 1), b) the step of increasing knitting widths of the front and back bodies, while widening stitches in knitting zones extending from underarms to before shoulder parts, so that the front body can be made larger in knitting width than the back body, with the front and back bodies split from each other at both ends thereof (Knitting zone 2), c) the step of knitting the front and back bodies to necklines by a flechage knitting, while forming shoulder drops in knitting zones of the shoulder parts (Knitting zone 3), d) the step of binding off the necklines of the front and back bodies respectively (Knitting zone 4), and e) the step of shifting the front and back bodies by loop transference so that their shoulder parts extending rightward and leftward across the necklines can confront each other, and joining together the shifted shoulder parts of the front and back bodies and binding them off (Knitting zone 5).

In the step c), the front body is knitted to be longer in a lengthwise direction thereof than the back body.

The loop transference in the step e) is carried out using empty needles provided by a process of binding off the necklines.

In the step b), the number of wales to form the necklines is increased by widening stitches so that the neckline of the front body can be increased in size by a degree of 1.4–2.0 times the neckline of the back body.

Also, the present invention provides knitwear with a drape neck which is knitted in tubular form in a substantially seamless manner, with the front and back bodies joined together at both ends of knitting widths thereof and at shoulder parts thereof, using a flat knitting machine, wherein knitting widths of the front and back bodies are increased in knitting zones extending from underarms to before shoulder parts, with the front and back bodies split from each other at both ends thereof, so that a drape can be formed around a neckline, wherein the number of widening stitches formed in the front body to be made larger in knitting width than the back body is more than the number of widening stitches formed in the back body, and wherein a shoulder drop is formed in shoulder parts by knitting the front and back bodies by a flechage knitting, and the front and back necklines are bound off, respectively.

Effect of the Invention

According to the knitwear knitting method of the present invention, since respective parts of knitwear knitted on the flat knitting machine can be joined together or bound off by a process using a knitting technology, without requiring any sewing process after knitted as conventional, the use of the sewing process after knitting can be eliminated or the work can be saved. Specifically, in the knitting zones extending from underarms to shoulders, the front body and the back body split at both ends thereof are increased in number of stitches so that the front body can be increased in knitting width beyond the back body. Further, in the knitting zones for shoulder parts, the front and back bodies are knitted by the flechage knitting so that their center parts can become longer in a lengthwise direction than lateral end parts thereof, whereby shoulder drops are formed in the shoulder parts. Accordingly, the number of wales to form the neckline of the front body is increased beyond the number of wales to form the neckline of the back body and further the number of courses formed around the neck is increased beyond the number of courses formed in the rest. Thereafter, the front and back necklines are prevented from being loosened by a bind-off process. Then, shoulder parts of the front and back bodies are shifted to confront each other across their necklines so that the front and back bodies can be joined together and bound off at their shoulder parts, and then bound off thereat. As a result of this, the entire wales forming the neckline of the front body is gathered to the center and thereby the drape is formed at that neckline of the front body. Thus, since the knitwear thus knitted is formed substantially seamlessly, light and fashionable knitwear can be produced without its stretch being spoiled by sewing stitches.

Further, in the knitting zone for the shoulder parts, a larger drape can be formed by a process of the flechage knitting that the front body can be made longer in the lengthwise direction than the back body.

Further, through the use of empty needles provided when the knitted loops are released in the bind-off process of the necklines, the knitted fabric parts can be shifted so that the right and left shoulder parts of the front and back bodies can confront each other. Hence, smooth and effective knitting can be provided.

Further, a large drape can be formed in well-looking silhouette by widening stitches so that the neckline of the front body can be increased in size by a degree of 1.4–2.0 times the neckline of the back body.

BEST MODE FOR CARRYING OUT THE INVENTION

In the following, a certain preferred embodiment of the present invention will be described with reference to the accompanying drawings. First, one of the preferred embodiments of the present invention will be described by way of illustration with reference to FIGS. 1 to 3.

FIG. 1 shows a sweater 1 as knitwear knitted by the knitting method of the illustrated embodiment. FIG. 2 shows pattern papers used for knitting the sweater 1, FIG. 2-*a* showing a pattern paper of a front body 3 of the same, FIG. 2-*b* showing a back body 5 of the same, and FIG. 2-*c* showing the overlapped state of those pattern papers. Though the front body 3 and the back body 5 correspond in shape to each other in their parts extending from hems 6 to underarms 7, they are different in shape in their parts from after the underarms 7. FIG. 2-*c* shows the different part of the back body which is indicated by a dashed line. FIG. 3 is a diagram schematically showing the knitting of the bodies on the flat knitting machine, with the front body 3 arranged on the downside and the back body 5 arranged on the top side. Reference numeral 3*a* indicates a part of the front body 3 extending from hem 6 to before underarms 7, reference numeral 3*b* indicates a part of the same extending from before underarms 7 to shoulder 13, and reference numeral 3*c* indicates a shoulder part 13 of the same. Reference numerals 5*a*, 5*b*, and 5*c* indicate corresponding parts of the back body, respectively. The front body 3 and the back body 5 are knitted from their hems 6 toward their shoulder parts 13, 14.

The sweater 1 knitted in this embodiment has a size of 12 gauge corresponding to a medium size and the like. For convenience of explanation, it is presented in the form of a plain sleeveless knit with no pattern whose front body 3 is knitted with knitting needles of a front needle bed and whose back body 5 is knitted with knitting needles of a back needle bed. It is needless to say that the sweater 1 may have a structure pattern, such as jacquard or rib, and may have sleeves.

The flat knitting machines that can be used for this knitting include a two-bed or four-bed flat knitting machine, and a flat knitting machine including a transfer jack bed. As the basic idea of the way of knitting tubular knitwear in a seamless manner will be understood from the Patent Documents cited above, the explanation thereof is omitted here.

The sweater 1 is knitted by a process of sequentially knitting first a knitting zone 1 extending from hems 6 to underarms 7 (3*a* of the front body and 5*a* of the back body), then a knitting zone 2 extending from underarms 7 to before shoulder parts 13, 14 (3*b* of the front body and 5*b* of the back body), then a knitting zone 3 of the shoulders 13, 14 (3*c* of the front body and 5*c* of the back body), then a knitting zone 4 for necklines 15, 17 to be bound off, and then a knitting zone 5 for front and back shoulder parts 19, 20 to be joined and bound off.

In the knitting zone 1, the front body part 3*a* and the back body part 5*a* are knitted in tubular form by a known method, with the front body part 3*a* held with the needles of the front needle bed and the back body part 5*a* held with the needles of the back needle bed. This knitting is performed, for example, by the process of sequentially knitting first a course of the front body part 3*a*, using a common yarn feeder (not shown) to feed a yarn to needles of the front needle bed, followed by a course of the back body part 5*a* while feeding the yarn to needles of the back needle bed, being repeated from the hems 6 to the underarms 7.

In the knitting zone 2 or subsequent knitting zones, the front body and the back body are separately knitted using different yarn feeders so that the front body parts (3*b*, 3*c*) and the back body parts (5*b*, 5*c*) can be put in the state of being split at both ends thereof.

In the knitting zone 2, the knitting proceeds from underarms 7 to before shoulder parts 13, 14. The knitting of the front body part 3*b* is started with a decreased width between underarms 8R, 8L from the front body part 3*a*, and the knitting of the back body part 5*b* is started with a decreased width between 9R, 9L from the back body-part 5*a*. The width between the underarms 8R, 8L of the front body part is made larger than the width between the underarms 9R, 9L of the back body part. Then, the underarms 8R–9R and 8L–9L are bound off. It should be noted that the front body and the back body are increased in knitting width in such a manner that the front body part 3*b* can be increased in knitting width beyond the back body part 5*b* so that when the knitting of the knitting zones is completed, a front neckline 15 formed in the front body can be increased in size by a degree of 1.4–2.0 times a back neckline 17 formed in the back body, as mentioned later. In this embodiment, the increased knitting width is provided by a process of, for example, forming a widening stitch at lateral ends of each body on the inside of the knitting width thereof by a widening knitting, which is called an inside widening knitting, for each of a predetermined number of courses. For example, in the front body part, three widening stitches are formed twenty-six times for each of four courses, while in the back body part, two widening stitches are formed fourteen times for each of eight courses, so that the front neckline 15 can be increased in width by about 1.7 times the back neckline 17. In FIG. 3, reference numerals 23R, 23L indicate widening lines formed in the front body by the so-called inside widening knitting and reference numerals 25R, 25L indicate widening lines formed in the back body.

Then, in the knitting zone 3, a shoulder drop is formed so that a shoulder top can be located below the neckline by such a flechage knitting that the number of courses in a center part of the knitting width of the shoulder part is made larger than the number of courses in lateral end portions of the knitted fabric, and also a drape is formed by increasing the number of courses knitted in the center part. A larger drape can be formed by the knitting of increasing the number of courses of the front body beyond the number of courses of the back body so that the front body can have a larger length in the lengthwise direction to provide a length ratio of the front body to the back body of e.g. about 5:4 (about 100 courses in the front body and about 80 courses in the back body), as shown in FIG. 2-*c*. In FIG. 3, after the knitting needles located on the outer sides of the center part of the knitting width are put in the rest state, the knitting starts from the center part of the knitting width, adopting the flechage knitting that the knitting needles used for the knitting are gradually introduced toward the lateral ends of the knitting width on the outside thereof. In FIG. 3, reference numerals 27R, 27L indicate flechage-knit lines of the front body and refernace numerals 28R, 28L indicate flechage-knit lines of the back body. As an alternative to the knitting described above, a knitting method wherein the flechage knitting in the knitting zone 3 is made inoperative by being precluded from the knitting in sequence from the knitting needles located on the outer sides of the knitting width may be used for knitting to the necklines.

In the knitting zone 4, after the necklines in the front and back bodies are bound off, the knitted loops in the necklines are released from the knitting needles.

In the sequent knitting zone 5, the knitted fabrics are shifted so that the front and back bodies to be joined can confront each other across the neckline, in order to join their shoulder parts together and bind them off. As a result of the front body being increased in knitting width beyond the back body by the knitting in the knitting zone 2, the shoulder part of the front body is in the state of being held with the knitting needles of the front needle bed at the outside of the shoulder part of the back body. However, since the knitted loops in the neckline are released from the occupied knitting needles when bound off, the occupied knitting needles become empty needles used for transference of loops. Through the use of those empty needles for the transference and of the racking, the knitted fabrics are shifted so that the shoulder parts 19R, 19L of the front body and the shoulder parts 21R, 21L of the back body can confront each other. After the knitted loops in the front and back shoulder parts are put in the confronting state, the respective shoulder parts are joined to each other and then bound off, to form openings 10 of lower sleeve edges and an opening 11 of the neck. The knitting is ended in the manner described above.

In the knitwear thus knitted, the front and back shoulder parts are joined together, with result that the neckline of the front body is put in the state of being loosened therebetween, as shown in FIG. 1. Also, since the center part of the knitted fabric around the neckline is knitted by the flechage knitting in such a manner that the center part can be increased in number of courses beyond the parts lateral thereto, the drape is formed around the neckline. This can allow the knitting of knitwear having a drape neckline including for example an off-turtle neck sweater by forming the drape around the neck of the knitwear.

INDUSTRIAL APPLICABILITY

The present invention can produce seamless knitwear having drape formed around the neckline using the flat knitting machine.

EXPLANATION OF LETTERS OR NUMERALS

Figure 1:
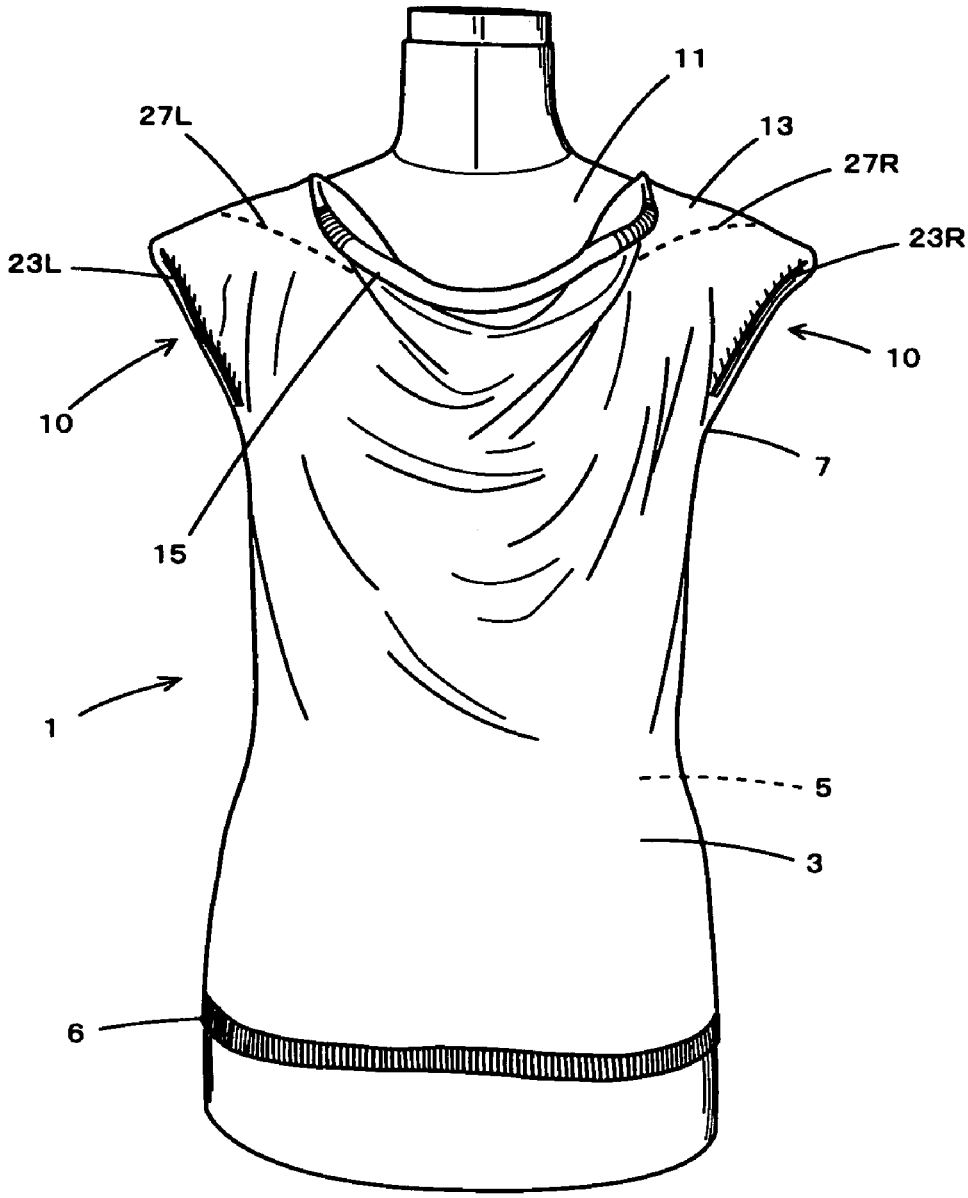
FIG. 1 is a sketch showing knitwear knitted by a preferred embodiment of the invention.
Figure 2:
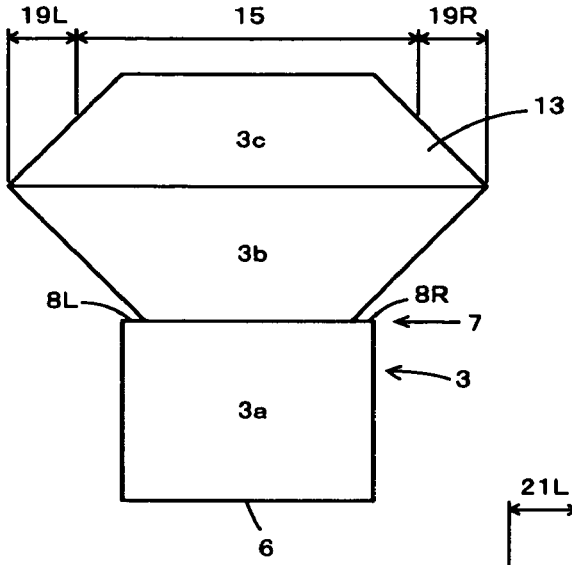
FIG. 2 is a diagram showing pattern papers of bodies used for knitting a sweater, FIG. 2-*a* showing a pattern paper of a front body of the same, FIG. 2-*b* showing a pattern paper of a back body of the same, and FIG. 2-*c* showing the overlapped state of the pattern papers of the front and back bodies.
Figure 2:
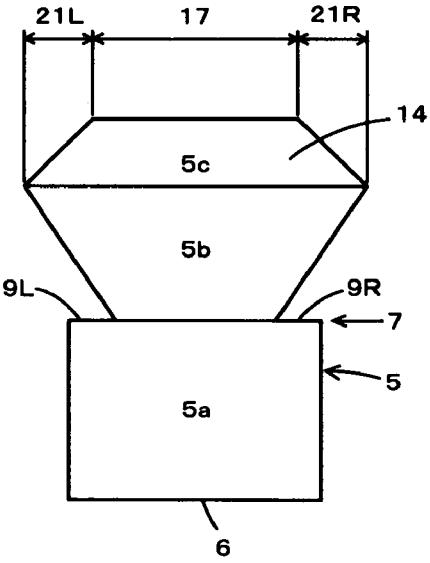
Figure 2:
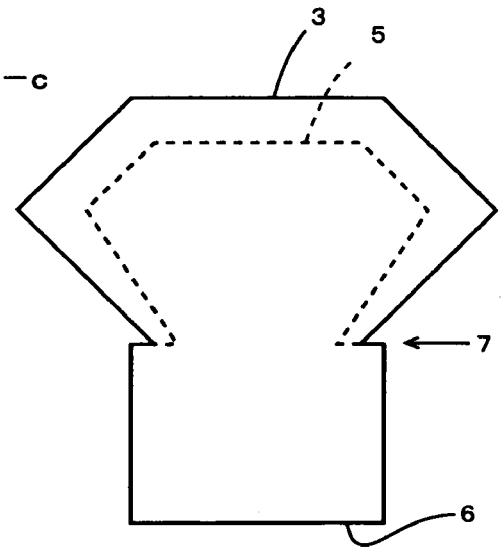
Figure 3:
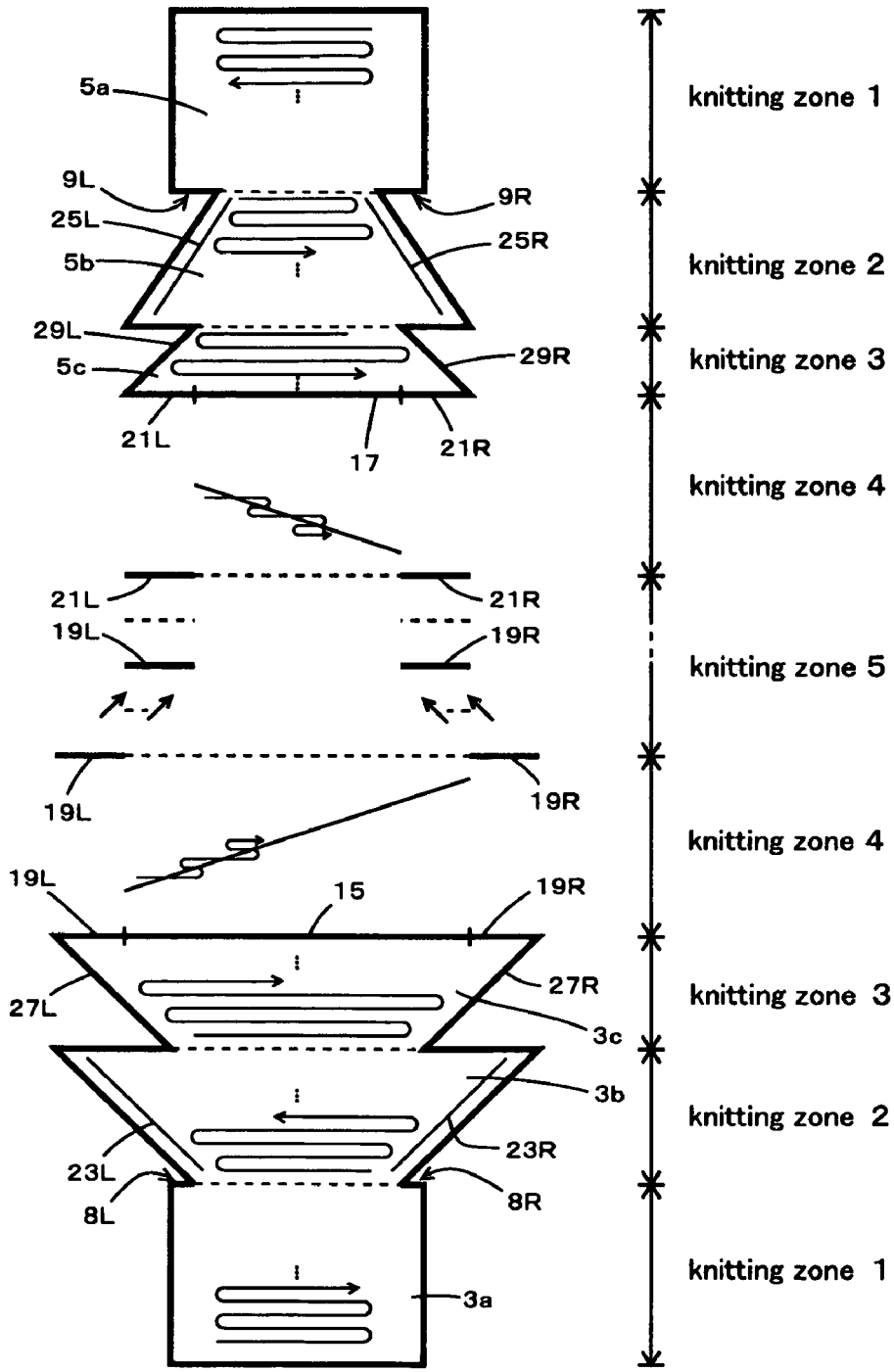
FIG. 3 is a diagram showing the steps of the knitting on the flat knitting machine.

| | | | |
|---|---|---|---|
| 1: | Sweater | 3: | Front body |
| 5: | Back body | 6: | Hem |
| 7: | Underarm | 8R, 8L: | Front underarm |
| 9R, 9L: | Back underarm | 10: | Openings of lower sleeve edges |
| 11: | Opening of the neck | 13, 14: | Shoulder |
| 15: | Front neckline | 17: | Back neckline |
| 19, 19R, 19L: Front shoulder line | | | |
| 21, 21R, 21L: Back shoulder line | | | |
| 23, 23R, 23L: Front widening lines | | | |
| 25, 25R, 25L: Back widening lines | | | |
| 27R, 27L: Front flechage-knit lines | | | |
| 29R, 29L: Back flechage-knit lines | | | |

The invention claimed is:

1. A knitting method for knitting knitwear in tubular form whose front body part and back body part are joined together at both ends of knitting widths thereof, with the front body part and the back body part assigned to a first needle bed and a second needle bed, respectively and which has a drape around a neck, by using a flat knitting machine having at least a pair of front and back needle beds extending in a transverse direction and disposed opposite to each other in a cross direction, at least either of which is capable of being racked in the transverse direction so that loops can be transferred between the front and back needle beds, the method comprising:

a) the step of knitting the front and back bodies in tubular form in knitting zones extending from hems to underarms, with front and back bodies joined at both ends thereof (Knitting zone 1), b) the step of increasing knitting widths of the front and back bodies, while widening stitches in knitting zones extending from underarms to before shoulder parts, so that the front body can be made larger in knitting width than the back body, with the front and back bodies split from each other at both ends thereof (Knitting zone 2), c) the step of knitting the front and back bodies to necklines by a flechage knitting, while forming shoulder drops in knitting zones of the shoulder parts (Knitting zone 3), d) the step of binding off the necklines of the front and back bodies respectively (Knitting zone 4), and e) the step of shifting the front and back bodies by loop transference so that their shoulder parts extending rightward and leftward across the necklines can confront each other, and joining together the shifted shoulder parts of the front and back bodies and binding them off (Knitting zone 5).

2. The knitwear knitting method according to claim 1, wherein in the step c), the front body is knitted to be longer in a lengthwise direction thereof than the back body.

3. The knitwear knitting method according to claim 1, wherein the loop transference in the step e) is carried out using empty needles provided by a process of binding off the necklines.

4. The knitwear knitting method according to claim 1, wherein in the step b), the number of wales to form the necklines is increased by widening stitches so that the neckline of the front body can be increased in size by a degree of 1.4–2.0 times the neckline of the back body.

5. Knitwear with a drape neck which is knitted in tubular form in a substantially seamless manner, with the front and back bodies are joined together at both ends of knitting widths thereof and at shoulder parts thereof, using a flat knitting machine, wherein knitting widths of the front and back bodies are increased in knitting zones extending from underarms to before shoulder parts, with the front and back bodies split from each other at both ends thereof, so that a drape can be formed around a neckline, wherein the number of widening stitches formed in the front body to be made larger in knitting width than the back body is more than the number of widening stitches formed in the back body, and wherein a shoulder drop is formed in shoulder parts by knitting the front and back bodies by a flechage knitting, and the front and back necklines are bound off, respectively.

* * * * *